US007669512B2

(12) United States Patent
Krause et al.

(10) Patent No.: US 7,669,512 B2
(45) Date of Patent: Mar. 2, 2010

(54) AMMUNITION FEED SYSTEM WITH AN AUTOMATIC CLUTCH

(75) Inventors: Klaus-Dieter Krause, Onex (CH); Hans Häfeli, Döttingen (CH); Michael Gerber, Zürich (CH)

(73) Assignee: Rheinmetall Air Defence AG, Zurich (CH)

( * ) Notice: Subject to any disclaimer, the term of this patent is extended or adjusted under 35 U.S.C. 154(b) by 0 days.

(21) Appl. No.: 11/705,943

(22) Filed: Feb. 14, 2007

(65) Prior Publication Data

US 2008/0034952 A1 Feb. 14, 2008

(30) Foreign Application Priority Data

Feb. 14, 2006 (DE) ..... 10 2006 006 961

(51) Int. Cl.
*F41A 9/00* (2006.01)

(52) U.S. Cl. ..... 89/33.5; 89/33.01; 89/33.1

(58) Field of Classification Search ..... 89/33.01, 89/33.5, 33.1–33.25
See application file for complete search history.

(56) References Cited

U.S. PATENT DOCUMENTS 3,977,514 A * 8/1976 Kaess ..... 198/853
4,311,082 A * 1/1982 Johnson et al. ..... 89/191.01
4,587,879 A * 5/1986 Savioli ..... 89/33.25
4,976,185 A * 12/1990 Wixon et al. ..... 89/35.01
5,111,732 A * 5/1992 Marcon et al. ..... 89/135
5,115,714 A * 5/1992 Muller et al. ..... 89/33.16
5,212,338 A * 5/1993 Maher ..... 89/45
5,239,911 A * 8/1993 Ostor ..... 89/33.1
5,335,579 A * 8/1994 David ..... 89/34
6,272,967 B1 * 8/2001 Bender-Zanoni et al. ... 89/33.04
6,345,562 B1 * 2/2002 Mannhart ..... 89/33.16
6,401,592 B1 * 6/2002 Rostocil ..... 89/33.16

* cited by examiner

*Primary Examiner*—Bret Hayes
*Assistant Examiner*—Michael D David
(74) *Attorney, Agent, or Firm*—Lucas & Mercanti, LLP; Klaus P. Stoffel

(57) ABSTRACT

An automatic clutch is integrated in a weapon system between an ammunition feed system and a cannon. A feeder feeds ammunition into the cannon. The clutch mechanism includes an actuator, a locking pin with an assisting spring or the like, and locking cams. The clutch mechanism allows the drum shaft of the cannon to be disengaged from the gear of the feeder between the cannon and the ammunition supply system and thus from the conveyance mechanism of the feeder.

5 Claims, 5 Drawing Sheets

AMMUNITION FEED SYSTEM WITH AN AUTOMATIC CLUTCH

BACKGROUND OF THE INVENTION

The invention pertains to an ammunition feed system with an automatic clutch, especially for a revolver cannon.

Ammunition feed systems in belted and unbelted (linkless) form, which convey the ammunition to the feeder of the weapon, are sufficiently well known. The linkless ammunition is characterized by the fact that the installed volume in the ammunition magazine is generally smaller than for belted ammunition.

EP 1 024 339 B1 describes an ammunition magazine for beltlessly conveyed ammunition. The cartridges are fed from the ammunition magazine to the weapon by an ammunition feed system. The goal is to prevent the occurrence of slack chain links, especially during acceleration of the ammunition drive chain.

Ammunition feed systems are usually connected with the cannon either rigidly or by a clutch and move the ammunition into the weapon or cannon according to the rate of fire.

With respect to loading or unloading the ammunition feed system and discharging the cannon, it is necessary, especially at high basic loads, to separate the cannon from the ammunition feed system. This can be accomplished by a manually operated clutch, which mechanically separates the ammunition feed system from the cannon. After disengagement, the cannon and ammunition feed system can be moved independently of each other and the operations of loading/unloading can be carried out. For loading the cannon itself and firing, the ammunition feed system and the cannon must be synchronized again by the clutch.

SUMMARY OF THE INVENTION

The object of the present invention is to replace manual operation with automatic operation.

The invention is based on the idea of integrating an automatic clutch between an ammunition feed system and a cannon. In this connection, it is intended that this clutch should keep a feeder, which feeds the ammunition to the cannon, mechanically separable from the cannon. The clutch mechanism consists essentially of an actuator (electrically driven), a locking pin with an assisting spring or the like, and locking cams.

The proposed solution allows automatic engagement with and disengagement from the cannon and automatic synchronization of the ammunition feed system with the cannon. This also creates the possibility of remote-controlled loading/unloading of the cannon. This also provides the further advantage of being able to use the cannon in unmanned gun towers, etc. Especially blank firing of the cannon and the associated improved readying of double feeding favorably distinguish the proposed solution. With this simple and robust solution, fast starting times can be realized, which allows use in cannons with high rates of fire, especially since only a small power and energy requirement is associated with the solution.

Further advantages, features and details of the invention are revealed in the following description of preferred exemplified embodiments and with the aid of the drawings.

DESCRIPTION OF THE INVENTION

Figure 1:
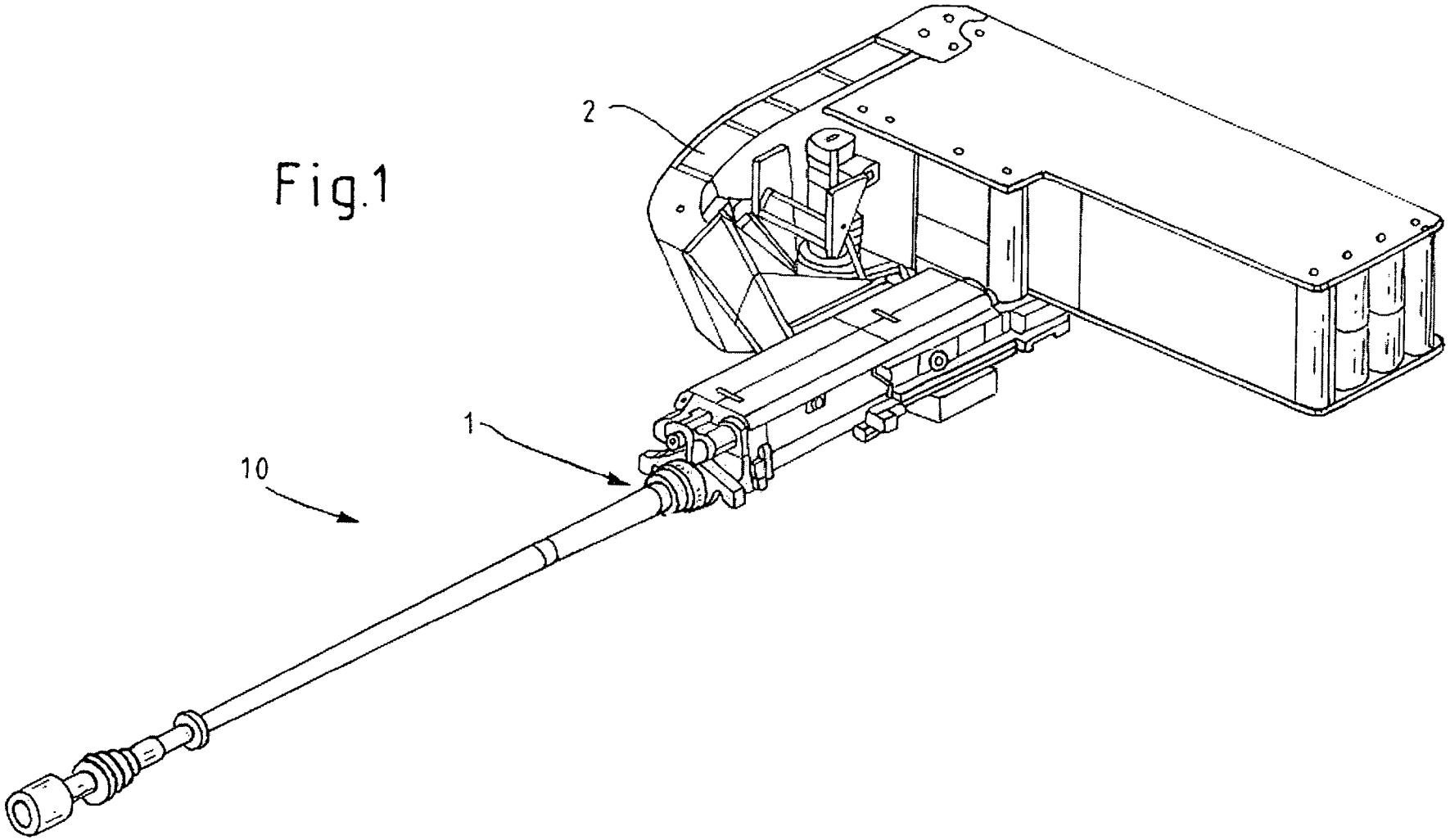
FIG. 1 shows a weapon system with an ammunition feed system and a cannon.

The operating principle of the invention will be described here on the basis of a revolver cannon 1, which, together with a linkless ammunition feed system 2, forms a weapon system 10, as shown in FIG. 1.

Figure 2:
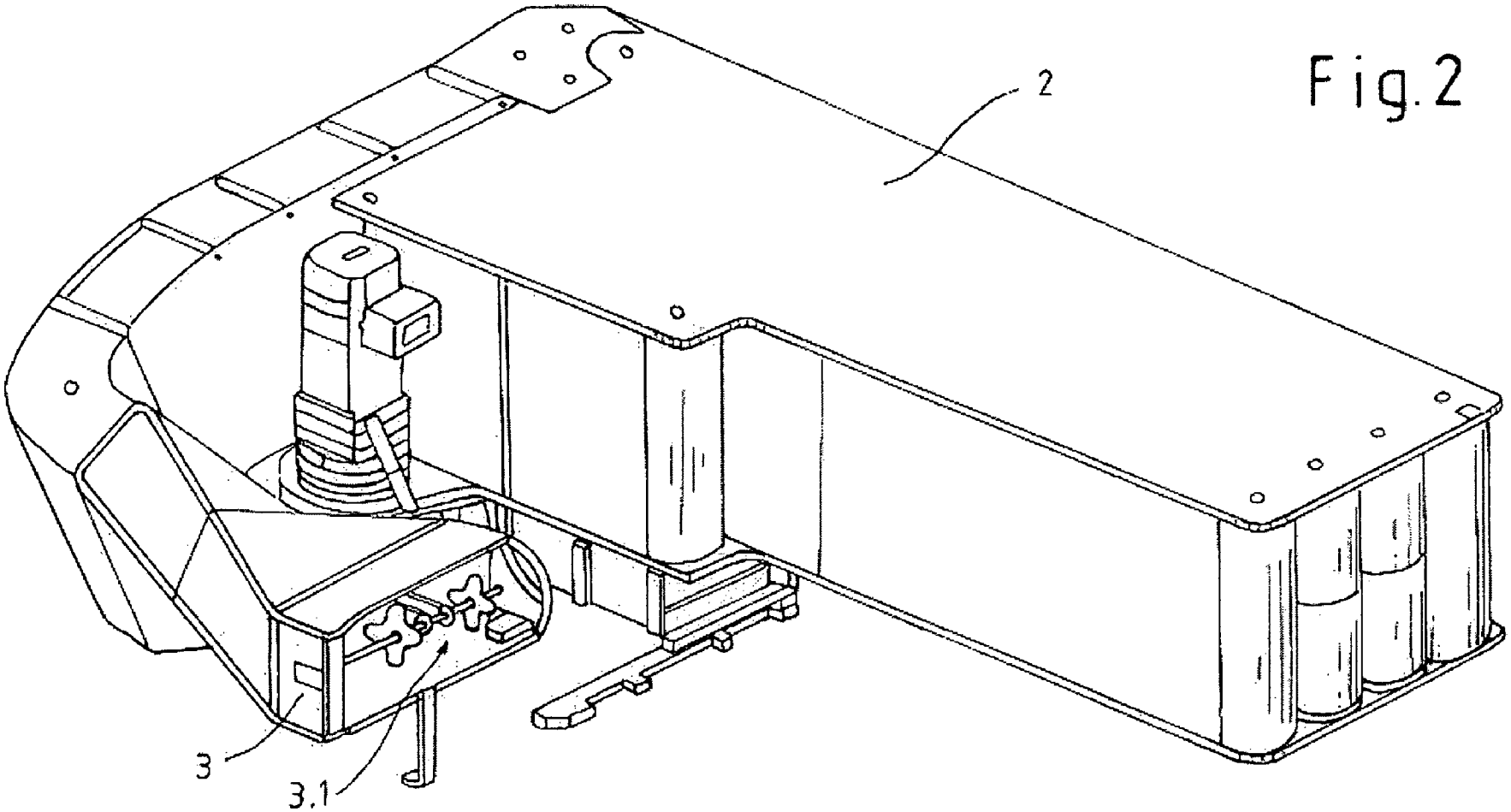
FIG. 2 shows the weapon system according to FIG. 1 without the cannon.

FIG. 2 shows the weapon system 10 without the cannon 1.

Figure 3:
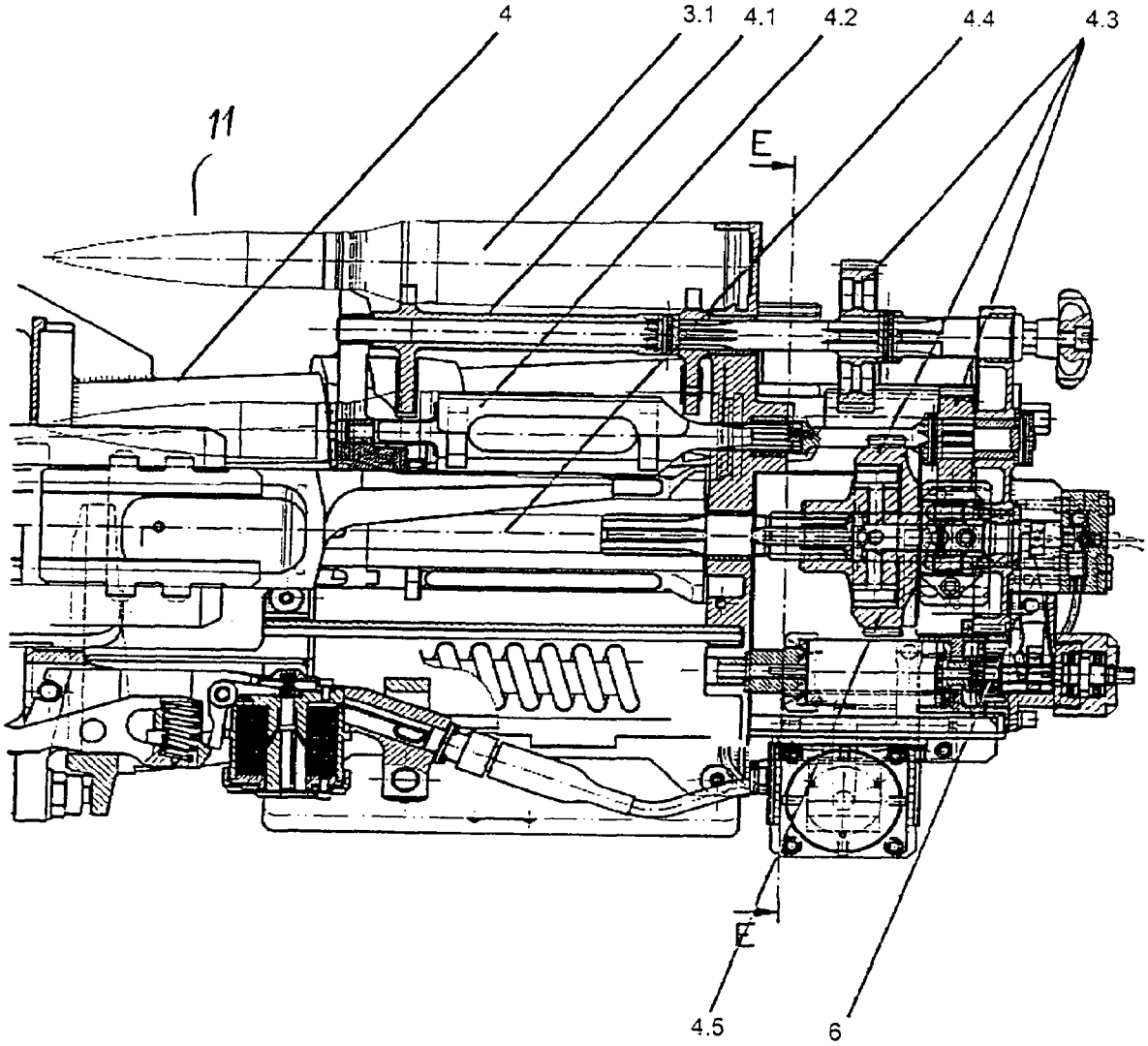
FIG. 3 shows a top view of a feeder with a novel clutch mechanism.

In the ammunition feed system 2, the ammunition 11 (FIG. 3) is preferably guided in conveyor chains, which are not specified in greater detail because they are already well known, and guided to the cannon 1 through a deflection station 3. Position 3.1 is the last cartridge position in the ammunition feed system 2 before the ammunition 11 is fed to the cannon 1. A feeder 4 of the cannon 1 removes the cartridge 11 from this position 3.1 of the linkless ammunition feed system 2 and moves it into the revolver drum of the cannon 1. The cartridges 11 in the feeder 4 are conveyed by a conveyor star wheel 4.1 and a butterfly element 4.2 for holding the cartridge in the barrel or cartridge chamber of the weapon, which conveyor star wheel and butterfly element are connected by gears 4.3, 4.5 with a rotor shaft 4.4 and the drum shaft of the cannon 1.

Figure 4:
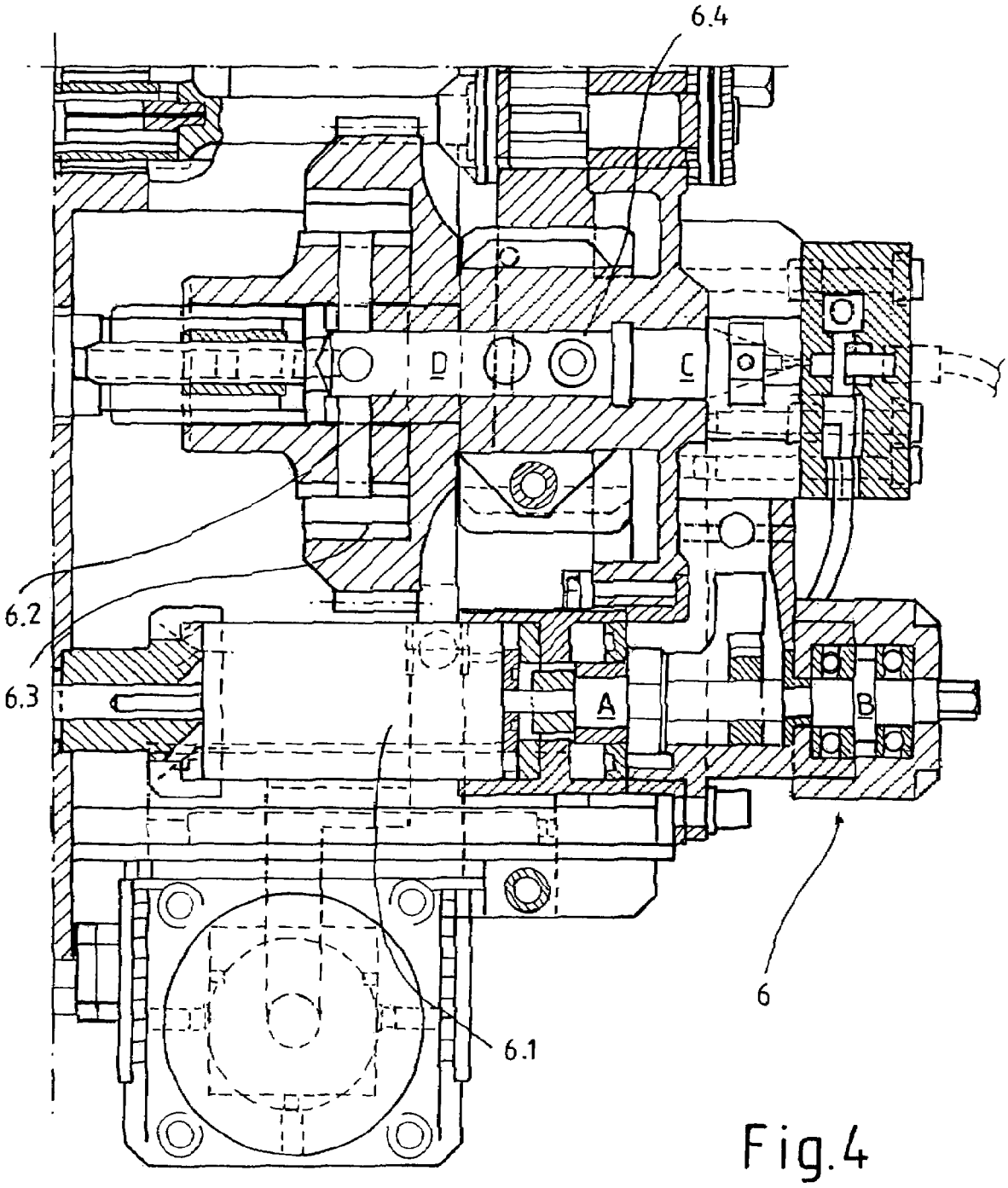
FIG. 4 shows a detail view of the feeder of FIG. 3.

A clutch mechanism 6 (FIG. 3) is functionally connected with the feeder 4 and effects the disengagement of the feeder 4 from the cannon 1. The clutch mechanism 6 (FIG. 4) disengages the rotor shaft 4.4 from the gear 4.5 (FIG. 5) and thus from the conveyor mechanism of the feeder 4, which consists of the conveyor star wheel 4.1 and the butterfly 4.2. To effect disengagement, an actuator 6.1 is brought into the end position A. This causes a locking pin 6.2 to be moved in direction C and the locking cams 6.3 to be released. To effect engagement, the actuator 6.1 is brought into end position B. Assisted by a spring 6.4, the locking pin 6.2 is moved in direction D, and the locking cams 6.3 are pushed into the locked position.

Figure 5:
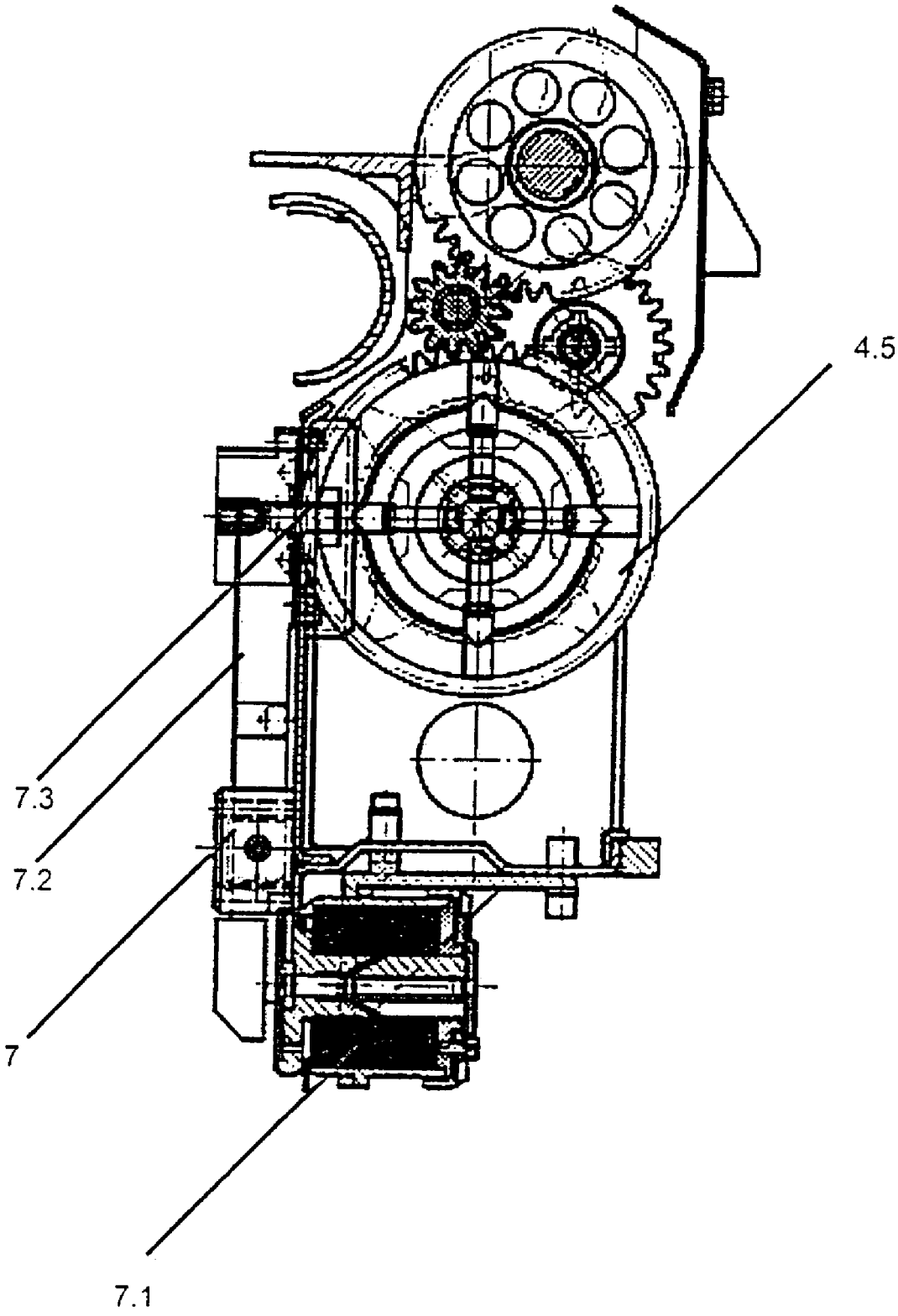
FIG. 5 shows a side view of the feeder.

To ensure that after the disengagement of the ammunition feed system 2, no more ammunition 11 can be moved into the feeder 4, for example, by overtravel or vibration, the gear 4.5 of the rotor shaft 4.4 is held by an additional catch 7 (FIG. 5). For this purpose, an additional actuator 7.1 is actuated, so that the catch lever 7.2 engages the groove 7.3 of the gear 4.5.

To load the ammunition feed system 2, the clutch 6 and the catch 7 are opened. The ammunition feed system 2 can then be moved freely, and the cartridges 11 to be fired can be moved as far as position 3.1 before the cannon 1. The actuator 7.1 of the catch 7 is then activated, and the ammunition feed system 2 is moved farther until the catch 7 engages. The ammunition feed system 2 and the cannon 1 are thus synchronized. The engagement of the clutch 6 connects the ammunition feed system 2 with the cannon 1, and the ammunition 11 is fed into the cannon 1 during loading or firing.

To interrupt automatic firing, first the catch 7 is activated and then the clutch 6 is disengaged. The catch 7 prevents additional ammunition 11 from entering the cannon 1 from the ammunition feed system 2. After the disengagement, the cannon 1 can be freely moved, and the ammunition present in the cannon 1 can still be fired.

Although the present invention has been described in relation to particular embodiments thereof, many other variations and modifications and other uses will become more apparent to those skilled in the art. It is preferred, therefore, that the present invention be limited not by the specific disclosure herein, but only by the appended claims.

The invention claimed is:

1. A linkless ammunition feed system for a revolver cannon, comprising:

a revolver cannon;

a feeder integrated in a position as a last cartridge position in the ammunition feed system before ammunition is fed to the cannon, the feeder being operative to feed the ammunition from the last cartridge position into the cannon, the feeder having a conveyor star wheel and a butterfly element for holding the cartridge in a barrel or cartridge chamber of the cannon, which are connected by gears with a rotor shaft and a drum shaft of the cannon; and an automatic clutch mechanism connected with the feeder and automatically movable between a position to effect disengagement of the feeder from the cannon so that the rotor shaft is disengaged from one of the gears and a position to effect reliable engagement and synchronization of the feeder and the cannon during firing of the cannon, the clutch mechanism including an electrically driven actuator.

2. The ammunition feed system in accordance with claim 1, wherein the clutch mechanism includes a locking pin and locking cams, wherein, to effect disengagement, the actuator is movable into a first end position A so as to cause the locking pin to move in a direction C parallel to the direction A and release the locking cams, and to effect engagement, the actuator is movable into a second end position B so as to cause the locking pin to move in a direction D opposite direction C whereby the locking cams are pushed into a locked position.

3. The ammunition feed system in accordance with claim 2, wherein the clutch mechanism further includes a spring arranged to assist movement of the locking pin in direction D.

4. The ammunition feed system in accordance with claim 1, and further comprising an additional catch arranged to hold and release the one gear of the rotor shaft of the feeder, and an additional actuator arranged to actuate a lever of the catch to engage or disengage a groove of the one gear.

5. The ammunition feed system in accordance with claim 1, wherein the ammunition is conveyed without links.

* * * * *